US005619545A

United States Patent [19]

Grummon et al.

[11] Patent Number: 5,619,545

[45] Date of Patent: Apr. 8, 1997

[54] PROCESS FOR PURIFICATION OF RADIOIODIDES

[75] Inventors: Glenn D. Grummon, St. Louis, Mo.; Michael A. Janik, Freeburg, Ill.

[73] Assignee: Mallinckrodt Medical, Inc., St. Louis, Mo.

[21] Appl. No.: 188,507

[22] Filed: Jan. 28, 1994

[51] Int. Cl.[6] ..... G21G 1/10

[52] U.S. Cl. ..... 376/195; 423/501; 210/682

[58] Field of Search ..... 423/2, 249, 501; 376/195; 210/682

[56] References Cited

U.S. PATENT DOCUMENTS

| | | | |
|---|---|---|---|
| 3,346,331 | 10/1967 | Nakamura et al. | 423/501 |
| 3,352,641 | 11/1967 | Nakamura et al. | 423/501 |
| 3,694,313 | 9/1972 | Blue et al. | 376/198 |
| 3,767,776 | 10/1973 | Bradford | 423/475 |
| 4,131,645 | 12/1978 | Keblys et al. | 423/501 |
| 4,451,375 | 5/1984 | Grinstead | 210/670 |

*Primary Examiner*—Ngoclan Mai

*Attorney, Agent, or Firm*—Wendell Ray Guffey; Thomas P. McBride; Brian K. Stierwalt

[57] ABSTRACT

The invention relates to a process for purifying radioiodides which comprises a) passing a recovered solution of iodide over an anion exchange resin;

b) washing the ion exchange resin in (a) with a solution comprising a weak base or anionic ion;

c) washing the ion exchange resin in (a) with a stronger solution than used in (b); and d) recovering a solution with iodide.

5 Claims, No Drawings

PROCESS FOR PURIFICATION OF RADIOIODIDES

FIELD OF THE INVENTION

The invention is in the field of radioisotopes. More particularly, the invention relates to a process for purifying radioiodides.

BACKGROUND OF THE INVENTION

Routine manufacturing of Iodides also results in production of iodate ions ($IO_3$–) and other impurities. If the end use for the Iodide is for medical diagnostic purposes, any iodate ions or other impurities must be below mandated limits. Also, iodide ions adversely affect radiolabelling of organic molecules.

The present invention provides a new process for purifying desired radioiodide from iodate and other impurities.

SUMMARY OF THE INVENTION

The invention relates to a process for purifying radioiodides which comprises:

a) passing a recovered solution of iodide over a anion exchange resin;

b) washing the ion exchange resin in (a) with a solution comprising a weak base solution or anionic ion;

c) washing the ion exchange resin in (a) with a stronger solution than used in (b); and d) recovering a solution containing the desired iodide ion.

Benefits of the new process include the recovery of the desired iodide ion without the iodate and other impurities.

DETAILED DESCRIPTION OF THE INVENTION

The general process for the manufacture of iodides can be exemplified by the manufacture of $^{123}$I produced in a cyclotron. The production of $^{123}$I iodide involves proton irradiation of a cyclotron target vessel that has been filled with pure $^{124}$Xe gas. A mixture of product isotopes is produced. The isotopes produced include $^{123}$Xe, $^{123}$Cs and $^{123}$I. For a final product of $^{123}$I, the $^{123}$Xe isotope and $^{123}$Cs isotope are allowed to decay to $^{123}$I. The target $^{124}$Xe gas is recovered, with the desired $^{123}$I product left in the target vessel. The target vessel is filled with pure water and heated to absorb the iodide products. The water, now containing the iodide products, is washed through an ion exchange resin to absorb the iodide ions. At this point, the ion exchange resin is generally eluted with a 0.02N sodium hydroxide solution in order to release the desired iodide solution in a concentration suitable for further use.

The process of the invention comprises a pre-wash step, before the 0.02N sodium hydroxide solution wash. The pre-wash step utilizes a solution that comprises a dilute base that removes impurities before the concentrated radioiodide solution is released by way of the 0.02N sodium hydroxide solution wash.

The present invention is also applicable to other iodides besides the above described $^{123}$I. Other iodides that can be purified with the process of the invention include $^{131}$I, $^{126}$I, $^{125}$I$^{124}$I and $^{121}$I. The production of iodides can utilize any production method including cyclotrons and reactors. Typical cyclotron procedures are disclosed in "Cyclotron Production of Medically Useful Halogen Radioisotopes"; R. Weinreich, S.M. Qaim, and G. Stocklin, *Nuclearmedizin* (16) 1978, 226–31, "Cyclotron Production of High-Purity Iodine-123 for Medical Application"; J. A. Jungerman, M.C. Lagunas-Solar, *Journal of Radioanalytical Chemistry*, Vol. 65, No. 1–2 (1981) 31–45, and "Recent Developments in the Production of $^{18}$F, $^{75,76,77}$Br, and $^{123}$I", S. M. Qaim, *Appl. Radiat. Sot.*, Vol. 37, No. 8, pp. 803–810, 1986. U.S. Pat. No. 4,622,201 also describes procedures useful in producing iodides. $^{131}$I can also be produced by neutron bombardment in a reactor and according to processes outlined in the *Manual of Radioisotope Production*, International Atomic Energy Commission, Vienna, Austria, 1966.

Ion exchange resins useful in practicing the invention include any weak anion exchange resin. Examples of suitable ion exchange resins for use in the invention include BioRex 5, BioRex Macropore Q materials (BioRex, BioRad BioRad Laboratories, 2000 Alfred Nobel Drive, Hercules, Calif. 94547), Amberlite IRA 93, Amberlite IRA 94, Amberlite IRA 68, Amberlite IRA 35 (Sigma Chemical Co., St. Louis, Mo. 63178), Dowex WGR-2 (Sigma Chemical Co., St. Louis, Mo. 63178), Sephadex DEA A-25 and Sephadex DEA A-50 (Sigma Chemical Co., St. Louis, Mo. 63178). The goal in choosing a resin for use in the process of the invention is to match a base strength wash which is compatible with the specific weak basic resin in order to perform the separation. This separation is routinely optimized depending on the resins and base solutions chosen.

Generic description of the column: The column which holds the resin is a holder, generally cylindrical in cross section, with a frit (screen) over both the top and bottom holding the resin in place. The column is constructed to provide for the eluent to be applied to the matrix material, disributed through that matrix, and collected for removal from the matrix. The matrix weight will generally be between 100 mg., and 5 grams. The weight (volume) is kept as low as practical so as to minimize the volume of eluant required for the rinsing operations since increased volumes, particularly for the iodide removal, should be as small as possible.

The wash solutions useful for practice with the invention comprise any water soluble base solutions that will release iodide and/or iodate from an ion exchange resin. Examples of suitable water soluble base solutions for use in the invention include hydroxide, fluoride, acetate, formate and phosphate solutions. Typical strengths of these base solutions range from about 0.0005 to about 0.005. Typical stronger strength solutions range from about 0.005 to about 1.0N. Strengths of wash solutions employed will differ with respect to the resin used. Any anionic ion which will release iodide and/or iodate from an exchange resin can also be used with the invention. Ions such as $OH^-$, $F^-$, acetate$^-$, formate$^-$, and phosphate are examples of suitable ions for use in the invention.

Recovery methods for obtaining the wash solutions include those generally known, such as those disclosed in U.S. Pat. No. 4,622,201.

The following examples illustrate the specific embodiments of the invention described in this document. As would be apparent to skilled artisans, various changes and modifications are possible and are contemplated within the scope of the invention described.

EXAMPLES

Example 1

A one hour bombardment was performed on a $^{124}$Xe target. After removal of the xenon target gas, the target was washed with pure water to absorb the iodide products. A small sample of the iodide solution (target rinsing solution) was taken prior to loading that solution on a Biorex 5 anion, and this solution was found to contain 0.89% iodate.

The target rinsing solution was loaded on a small ion exchange bed (Biorex 5 anion exchange resin) (supplied by the Bischoff Co.), and then rinsed with water.

Note: The normal apparatus for the recovery of the radioiodide calls for the loading of the ion exchange bed (column) from the top, rinsing of the column from the top, and then eluting the radioiodide from the bottom of the column out through the top. The following steps for the purification of the radioiodide call for the loading of the radioiodide from the column top, rinsing from the column top, and elution with both the 0.002N and 0.02N sodium hydroxide solutions from the top through the bottom.

The ion exchange bed was rinsed with 7 ml of 0.002 N sodium hydroxide. This rinse was collected, and subsequent analysis indicated 79% of the radioactivity in the 0.002N sodium hydroxide was in the form of the iodate ion.

The ion exchange bed was then rinsed with 0.02N sodium hydroxide, collecting the radioiodide which was released. Subsequent analysis indicated that 100% of this material was in the form of iodide ion. This solution would be identical in chemical concentration to the iodide produced without the pre-wash step, except iodate ions and other radioiodine-containing impurities are substantially removed.

The assays of the total activities in the 0.002N sodium hydroxide and the 0.02N sodium hydroxide solutions were 0.27 mCi and 3.54 mCi (7.1% and 92.9%).

Although the invention has been described with respect to specific modifications, the details thereof are not to be construed as limitations, for it will be apparent that various equivalents, changes and modifications may be resorted to without departing from the spirit and scope thereof, and it is understood that such equivalent embodiments are to be included therein.

What is claimed is:

1. A process for purifying cyclotron produced $^{123}I$ which comprises:

(a) passing a recovered solution of a cyclotron produced iodide over an anion exchange resin;

(b) washing the ion exchange resin in (a) with a weak solution comprising NaOH;

(c) washing the ion exchange resin in (a) with a stronger solution of NaOH than used in (b); and (d) recovering the wash solution of (c).

2. The process of claim 1 in which the NaOH solution of (b) is from about 0.0005N to about 0.005N.

3. The process of claim 1 in which the NaOH solution of (c) is from about 0.005N to about 1.0N.

4. A process for purifying cyclotron produced $^{123}I$ which comprises:

(a) passing a recovered solution of a cyclotron produced iodide over an anion exchange resin;

(b) washing the ion exchange resin in (a) with about a 0.002N solution of NaOH;

(c) washing the ion exchange resin in (a) with about a 0.02N solution of NaOH; and (d) recovering the wash solution of (c).

5. A process for purifying cyclotron produced radioiodides selected from the group consisting of $^{121}I$, $^{123}I$, $^{124}I$, $^{125}I$, and $^{126}I$ which comprises:

(a) passing a recovered solution comprising iodide over an anion exchange resin;

(b) washing the ion exchange resin in (a) with a solution comprising from about 0.0005N to about 0.005N of a weak base;

(c) washing the ion exchange resin in (a) with a solution comprising from about 0.01N to about 1N of a weak base; and (d) recovering the wash solution of (c).

* * * * *